US006273548B1

(12) United States Patent
Grüner et al.

(10) Patent No.: US 6,273,548 B1
(45) Date of Patent: Aug. 14, 2001

(54) METHOD AND CIRCUIT FOR CONTROLLING NOZZLE HEADS IN INKJET PRINTERS, IN PARTICULAR NOZZLE HEADS OF PIEZOELECTRIC DEVICE TYPE

(75) Inventors: Manfred Grüner, Ulm; Berthold Löw, Erbach, both of (DE)

(73) Assignee: Tally Computerdrucker GmbH, Ulm-Elchingen (DE)

( * ) Notice: Subject to any disclaimer, the term of this patent is extended or adjusted under 35 U.S.C. 154(b) by 0 days.

(21) Appl. No.: 09/267,841

(22) Filed: Mar. 12, 1999

(30) Foreign Application Priority Data

Mar. 13, 1998 (DE) ..... 198 10 849

(51) Int. Cl.[7] ..... B41J 2/15
(52) U.S. Cl. ..... 347/40; 347/41; 347/12
(58) Field of Search ..... 347/40, 41, 42, 347/43, 9, 12, 14, 10, 11

(56) References Cited

U.S. PATENT DOCUMENTS

| | | | | |
|---|---|---|---|---|
| 4,864,328 | * | 9/1989 | Fischbeck | 347/40 |
| 5,075,689 | * | 12/1991 | Hoisington et al. | 347/40 |
| 5,079,571 | * | 1/1992 | Eriksen | 347/43 |
| 5,371,529 | | 12/1994 | Eguchi et al. | 347/7 |
| 5,430,469 | * | 7/1995 | Shioya et al. | 347/15 |
| 5,563,955 | | 10/1996 | Bass et al. | 382/101 |
| 5,940,093 | * | 8/1999 | Bolash et al. | 347/41 |

FOREIGN PATENT DOCUMENTS

| | | |
|---|---|---|
| 4221963 | 6/1992 | (DE) . |
| 4223454 | 7/1992 | (DE) . |
| 4391850 | 4/1993 | (DE) . |
| 4226236 | 2/1994 | (DE) . |
| WO9507185 | 9/1994 | (WO) . |

* cited by examiner

*Primary Examiner*—N. Le
*Assistant Examiner*—Lamson D. Nguyen
(74) *Attorney, Agent, or Firm*—Horst M. Kasper

(57) ABSTRACT

A circuit for controlling nozzle heads in inkjet printers includes a first plurality of nozzles disposed in a row forming an angle relative to a horizontal and to a line direction, respectively, wherein the nozzles of the first plurality of nozzles exhibit a defined distance from each other, and wherein the nozzles of the first plurality of nozzles are to be shot off without a time delay, and a second plurality of nozzles disposed in the row forming the angle relative to the horizontal and to the line direction, respectively, and electronically distinguished from the first plurality of nozzles, wherein the nozzles of the second plurality of nozzles exhibit a defined distance from each other, and wherein the nozzles of the second group of nozzles are disposed interleaved relative to the first plurality of nozzles.

25 Claims, 7 Drawing Sheets

○ = nozzle position during shooting off of the first sequence

● = print position on the paper

METHOD AND CIRCUIT FOR CONTROLLING NOZZLE HEADS IN INKJET PRINTERS, IN PARTICULAR NOZZLE HEADS OF PIEZOELECTRIC DEVICE TYPE

BACKGROUND OF THE INVENTION

1. Field of the Invention

The invention relates to a method and circuit for controlling nozzle heads in inkjet printers, in particular nozzle heads of the piezo construction form.

2. Brief Description of the Background of the Invention Including Prior Art

When nozzles are disposed physically closely spaced next to each other in nozzle rows of for example 128 nozzles, it is not possible to shoot simultaneously nozzles disposed neighboring each other. This disadvantage of high nozzle numbers is balanced by an inclined arrangement of the nozzle head or, respectively, of the nozzle row. Such an arrangement of the nozzle rows therefore requires a delayed shooting off of individual nozzles relative to the slider motion and the incorporation angle of the nozzle row. Such a delay circuit is known from the German printed patent document DE-42 26 236 C1. The known unit serves for generating the print cycle and represents a simple method for the delay of the point or dot shooting off with a timer. The known method however cannot be employed in this case, since the distance by which for example the lowest nozzle of the nozzle row has to be delayed corresponds to the complete head width and thus speed variations of the nozzle head would lead immediately to clearly visible print picture distortions.

U.S. Pat. No. 5,563,955 shows a digital signal processor.

SUMMARY OF THE INVENTION

3. Purpose of the Invention

It is a an object of the present invention to achieve a sufficiently point-precise printing of individual nozzles in a nozzle row or, respectively, nozzle rows, disposed at an angle relative to a horizontal line or, respectively, to a print line, and in case of a high nozzle number.

These and other objects and advantages of the present invention will be come evident from the description which follows.

BRIEF DESCRIPTION OF THE INVENTION

According to the present invention there is provided for a circuit for controlling nozzle heads in inkjet printers. A first plurality of nozzles is disposed in a row forming an angle relative to a horizontal and to a line direction, respectively. The nozzles of the first plurality of nozzles exhibit a defined distance from each other and the nozzles of the first plurality of nozzles are to be shot off without a time delay. A second plurality of nozzles is disposed in the row forming the angle relative to the horizontal and to the line direction, respectively, and is electronically distinguished from the first plurality of nozzles. The nozzles of the second plurality of nozzles exhibit a defined distance from each other. The nozzles of the second group of nozzles are disposed interleaved relative to the first plurality of nozzles and the nozzles of the second plurality of nozzles are to be shot off with a time delay of a fraction of a pixel distance. A third plurality of nozzles is disposed in the row forming the angle relative to the horizontal and to the line direction, respectively, and is electronically distinguished from the first plurality of nozzles and from the second plurality of nozzles. The nozzles of the third plurality of nozzles exhibit a defined distance from each other. The nozzles of the third group of nozzles are disposed interleaved relative to the first plurality of nozzles and relative to the second plurality of nozzles. The nozzles of the third plurality of nozzles are to be shot off with a time delay of a multiple of said fraction of the pixel distance. A digital signal processor is connected to the first plurality of nozzles, to the second plurality of nozzles, and to the third plurality of nozzles for controlling the first plurality of nozzles, the second plurality of nozzles, and the third plurality of nozzles. A data processing unit is connected to the digital signal processor for switching the digital signal processor. A unit for generating a print cycle is connected to the data processing unit for delivering print data to the data processing unit. The data processing unit processes the print data as an image of a print line.

Nozzle heads of the first plurality of nozzles, of the second plurality of nozzles, and of the third plurality of nozzles can be of piezo construction. The nozzles of the first plurality of nozzles, of the second plurality of nozzles, and of the third plurality of nozzles can be physically closely spaced. The first plurality of nozzles, the second plurality of nozzles, and the third plurality of nozzles can be disposed on nozzle heads with each having 128 nozzles and furnishing a point grid of 360 dpi.

Preferably, the data processing unit includes a microprocessor, a program storage connected to the microprocessor, a data storage connected to the microprocessor, interfaces connected to the microprocessor for receiving data, a character generator connected to the microprocessor, a memory connected to the microprocessor, and two direct memory access DMA channels connected to the memory and furnished with a direct memory access.

The nozzles of the second plurality of nozzles can be shot off with a time delay corresponding to ⅓ of a distance between two pixels. The nozzles of the third plurality of nozzles can be shot off with a time delay corresponding to ⅔ of a distance between two pixels.

The digital signal processor can be constructed to allow firing successively different sequences of the first plurality of nozzles, of the second plurality of nozzles, and of the third plurality of nozzles.

The pixels can be time delayed relative to an inclination position of the nozzle row for printing a vertical line.

Preferably, a nonlinear time delay relative to a nozzle position is to be applied for shooting off individual nozzles in an incorporation position of 360 dpi.

A tangent of the angle (alpha) relative to the horizontal and to the line direction, respectively, can be defined by the following formula:

$$\text{tang(alpha)}=n/((a\cdot n)-x),$$

wherein n is equal to a natural number at least 1, x is equal to a natural number between 1 and n−1, a is equal to a second natural number.

The tangent of the angle (alpha) can be defined by parameters as follows:

n is less than 10, x is equal to 1 or n−1, a is not larger than n.

The tangent of the angle (alpha) can be defined by parameters as follows:

n is equal to 3, x is equal to 1,
a is equal to 2.

The digital signal processor can be a digital signal microprocessor.

The digital signal processor can be a general purpose microprocessor working faster than a common digital signal microprocessor.

The object of the present invention is achieved according to the method steps of the present invention for a method for controlling nozzle heads in inkjet printers, in particular nozzle heads of the piezo construction, with physically closely spaced nozzles. The nozzles are disposed in an inclined nozzle row. The inclined nozzle row is electronically subdivided into groups A, B, C. Nozzles belonging to one group A or B or C jump in each case over the nozzles of another group A or B or C, such that the nozzles exhibit a physical distance within an electronically controllable group A, B, C. The nozzles of a first group A are shot off without a time delay. The nozzles of a second group B are shot off with a time delay corresponding to a fraction of a the distance between two pixels. The nozzles of a third group C are shot off with a time delay corresponding to a multiple of this fraction of the distance between two pixels. The grid points are time delayed relative to the inclination position of the nozzle head or, respectively, of the nozzle rows for printing a vertical line. A nonlinear delay is applied for shooting off individual nozzles with an incorporation position of 360 dpi.

Based on this construction, for example only every third nozzle can be shot off simultaneously. Different shooting sequences can be adjusted and set through an electronic nozzle-head control circuit. An overall very precise print picture is therefore generated.

According to the embodiment of this method, it is disclosed that the nozzles to be shot off with a delay are shot off with a time delay corresponding to a displacement of ⅓ between neighboring grid points or pixels and the additional nozzles to be shot off with a delay are shot off with a time delay corresponding to a displacement of ⅔ between neighboring grid points or pixels. These delays therefore balance very precisely the distance passed over by the slider and the incorporation angle of the nozzle rows.

According to further features, it is furnished that different sequences of the groups (A-B-C or C-B-A) are released sequentially. The nozzle distance of the nozzle head and the incorporation angle thereby determine a possible horizontal and vertical resolution.

Based or these considerations it is furthermore advantageous if the grid points or pixels are time delayed relative to the inclined position for of the nozzle head or, respectively, of the nozzle row for printing a vertical line. For this purpose, however, suitable delay means have to be employed.

It is further recommended that a nonlinear delay is employed for the shooting off of individual nozzles in case of a 360 dpi incorporation position.

The presented task with respect to apparatus technology or, respectively, switching technology is resolved by the features of the present invention. A circuit for controlling nozzle heads in inkjet printers, in particular nozzle heads of piezo construction, includes physically closely spaced nozzles. The nozzles are disposed in a row forming an angle relative to the horizontal or, respectively, to the line direction. An inclined nozzle row is electronically subdivided into groups A, B, C. Furthermore, in each case nozzles belong to a group A or B or C, which jump over the nozzles of another group A or B or C, such that the nozzles exhibit a physical distance within an electronically controllable group A, B, C. In addition the nozzles of a first group A can be shot off without a time delay, the nozzles of a second group B can be shot off with a time delay by a fraction of a pixel, and the nozzles of a third group C can be shot off with a time delay by a multiple of this fraction of a pixel. The nozzle row is connected to a data processing unit with an intermediate positioning and switching of a digital signal processor for a control of nozzle heads with in each case 128 nozzles and a point grid of 360 dpi. The data processing unit processes the print data as an image of a print line. The data processing unit is connected to a unit for generating the print cycle.

This hardware solution is neither complicated nor expensive or costly based on employment of a digital signal processor DSP. Even different modes of printing can be performed in the printer, for example 180 dpi forward printing, 180 dpi reverse printing, 360 dpi forward printing, 360 dpi reverse printing, and the like. It is possible in this case to distribute the print points and dots suitably for each of these modes of operation.

The solution based on a digital signal processor DSP is in addition advantageous for the reason that the print dots can be distributed correspondingly in a print buffer (RAM) depending on the set printing mode. Since for this distribution each bit (corresponds to a nozzle) has to be extracted from a byte and has to be changed into another byte by entering into an OR element, the requirements to such a system are very high. The digital signal processor DSP meets these requirements, while the known processors and storage media, typically employed for so-called embedded controllers, do not meet these requirements. In addition, there results a very simple reversibility between left printing and right printing. In addition, an inverse incorporation of the nozzle head is possible without additional hardware expenditures. Finally, a flexibility is made possible between different nozzle heads incorporated at an inclined angle (different delay division). In this case, only a software adaptation is required.

It is furthermore advantageous that the data processing unit is formed of a micro-processor with program storage and with data storage, with interfaces for receipt of data and with a character generator and two direct memory access DMA channels with an immediate memory storage access.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF THE INVENTION AND PREFERRED EMBODIMENTS

Figure 1:
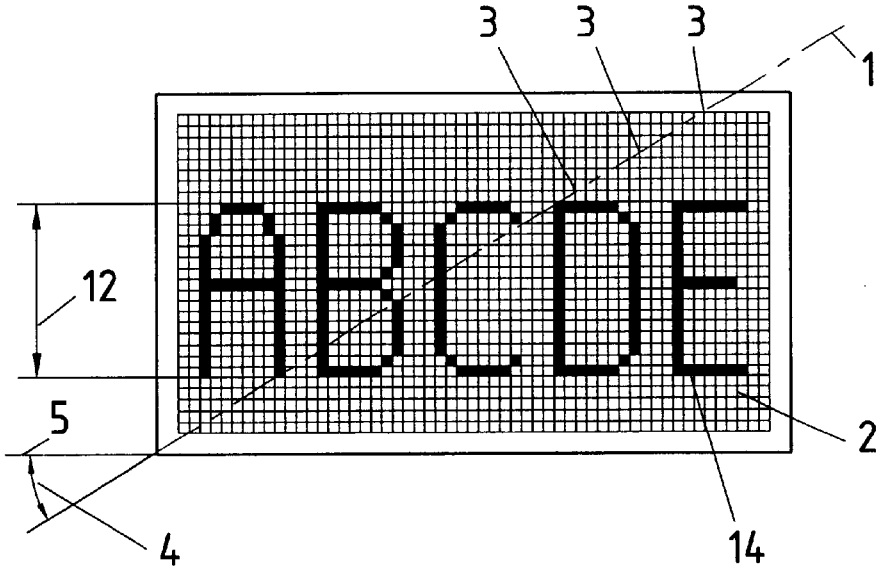
FIG. 1 shows the inclined incorporation of a nozzle head with a nozzle row with reference to a point grid.

According to the present invention, there is provided for a circuit for controlling nozzle heads 10*a*, 10*b* movable in line direction 5 relative to the recording material in inkjet printers, in particular having nozzle heads 10*a*, 10*b* of piezo construction, with nozzles 3 disposed physically closely spaced. The nozzles 3 form nozzle rows 1 running at an angle 4 relative to the line direction 5. The nozzles 3 of one nozzle row 1 are connected to a data processing unit 11 and are electronically subdivided into groups A, B, C. In each case the nozzles 3 belonging to a group A, B, C jump over the nozzles 3 of another group A, B, C, such that the nozzles 3 exhibit a physical distance within a group A, B, C. The nozzles 3 of a first group A can be shot off without a time delay. The nozzles 3 of a second group B can be shot off with a time delay by a fraction of a pixel distance relative to the nozzles 3 of the first group A. The nozzles 3 of a third group C can be shot off with a time delay by a multiple of this fraction of the pixel distance relative to the nozzles 3 of the first group A. The nozzle rows 1 are connected to the data processing unit 11 with an intermediate positioning and switching of a digital signal processor DSP for a control of nozzle heads 10*a*, 10*b* with a large number of nozzles and a fixed mounting position. The data processing unit 11 processes the print data as an image of a print line 12. The data processing unit 11 is connected to a unit 13 for generating the print cycle.

A nozzle row 1 in a grid field 2 under an angle of 30.96° at 128 nozzles 3 in the nozzle head forms the basis according to FIG. 1. The nozzles 3 are disposed physically very close next to each other and it is therefore not possible, based on the construction, to shoot off neighboring or adjoining nozzles 3 at the same time. The nozzles can be disposed at a distance of from about 0.08 millimeters to 0.15 millimeters from the middle of one nozzle to the middle of a neighboring nozzle. The embodiment includes a nozzle distance of 0.1371 millimeters. The diameter of the nozzles can be preferably from 0.02 to 0.05 millimeters. The embodiment exhibits a nozzle diameter of 0.03 millimeters.

This disadvantage of being unable to simultaneously shoot off adjacently disposed nozzles is balanced by an inclined incorporation of the nozzle head, such that the nozzle row 1 runs at an incorporation angle 4 relative to the line direction 5. Several such nozzle rows 1 can be furnished disposed staggered and parallel to each other. The angle relative to a horizontal direction or longitudinal line direction can be from about 25 to 35 degrees. An embodiment employed an angle of 31 degrees. Such nozzles are commercially available from "Modulat Ink Technology Stockholm AB/MIT".

Figure 2:
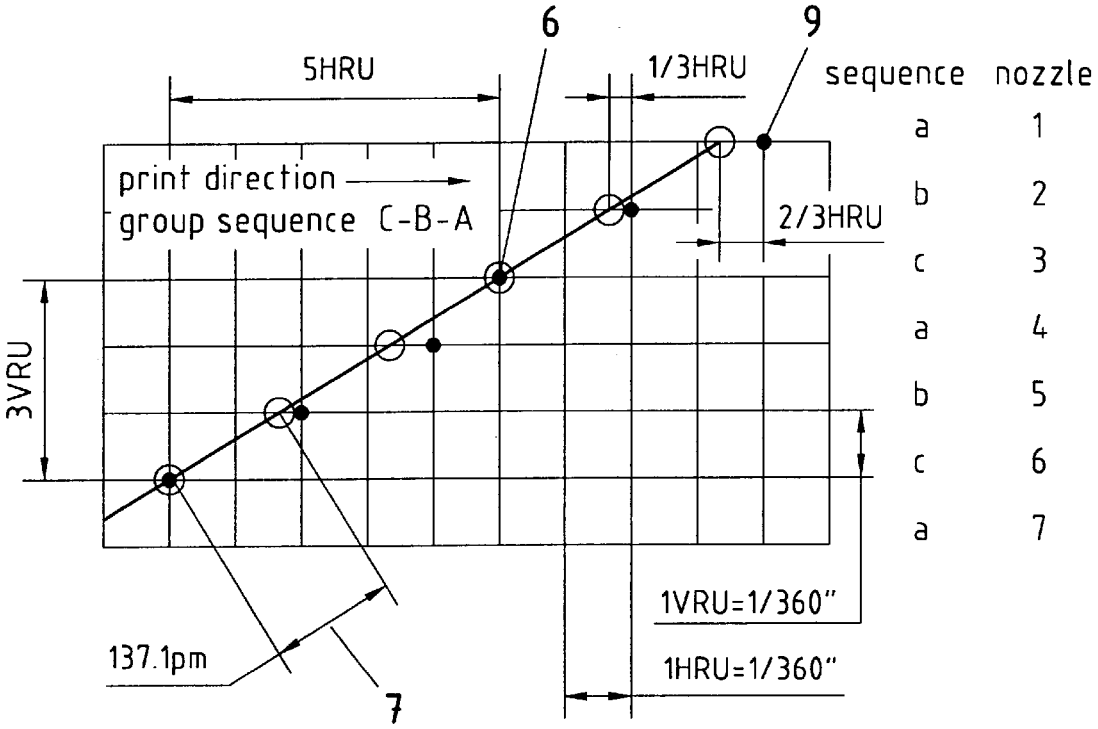
FIG. 2 shows a shooting sequence C-B-A in the grid field.

The electronic control of the nozzle head shoots always only every third nozzle at the same time (FIG. 2). The nozzles 3 our subdivided into three groups (group A: nozzles number 1, 4, 7 etc.; group B: nozzles number 2, 5, 8 etc.; group C: nozzle number 3, 6, 9 etc.). The electronic group subdivision (A, B, C,) furnishes that nozzles 3 skipping over one group (A or B or C) in each case belong to the nozzles 3 of another group (A or B or C), such that the nozzles 3 exhibit a physical distance within an electronically controllable group (A, B, C), and that the nozzles of the first group A are shot off without delay, the nozzles of the second group B are shot off delayed by a fraction of a pixel 6 to pixel time period, and the nozzles of the third group C are shot off delayed by a multiple of this fraction of the pixel 6 to pixel time period. As a rule, the nozzles 3 to be shot off with a delay are shot off with a delay of ⅓ of the time period between two pixels and the additional nozzles 3 to be shot off with a delay are shot off with a delay of ⅔ of the time period between two pixels.

In addition to the sequence C-B-A illustrated in FIG. 2, a sequence A-B-C of the groups can also be released. The sequence A-B-C means in this context that the nozzles 3 of the group A are shot off without delay, the nozzles 3 of the group B are shot off with a delay of ⅓ of the time period between two pixels and the nozzles 3 of the group C are shot off with a delay of ⅔ of the time period between two pixels. The coordination is inverse for the shooting sequence C-B-A as is shown in FIG. 2. The nozzle distance 7 of the nozzle row 1 and the incorporation angle 4 determine in this case the possible horizontal resolution and vertical resolution. The distances "HRU" entered in FIG. 2 mean a "horizontal resolution unit" and "VRU" mean a "vertical resolution unit".

Figure 3:
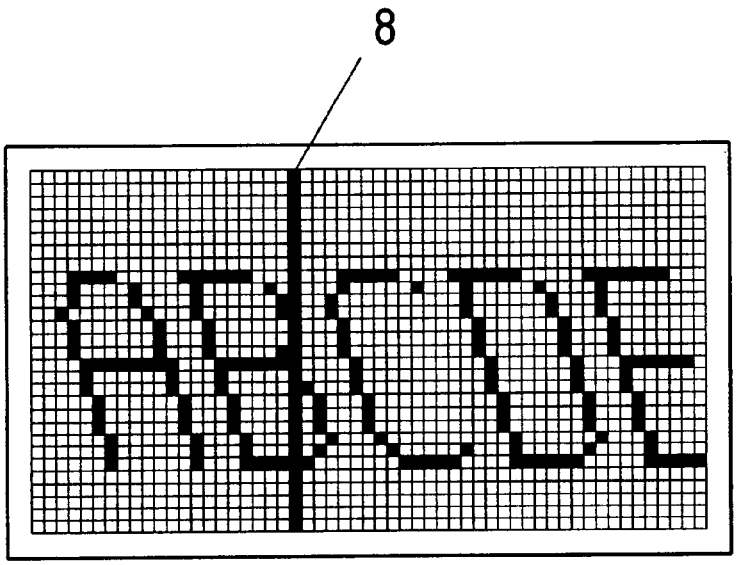
FIG. 3 shows a delay method relative to the inclined position to the nozzle row and for printing of a vertical line.

The print dots 9 have to be delayed relative to the inclined position of the nozzle row 1 for printing a vertical line 8 (FIG. 3). It is to be taken into consideration that a nonlinear delay is employed for the shooting off of individual nozzles 3 in case of a 360 dpi incorporation position. The resolution can be from about 300 dpi to 1200 dpi. The nonlinear delay serves for an arbitrary or desired adjustment or setting of the position of a line to be printed vertically, wherein the line thereafter can also be printed at an inclined angle, wherein the inclined position is generated by a corresponding nonlinearity according to a defined curve.

The electronic circuit (FIG. 4) is furnished in each case with 128 nozzles and a point grid of pixels of 360 dpi for controlling nozzle heads or, respectively, nozzle rows 1. Each nozzle head can carry from about 100 to 500 nozzles. In this case, each print head 10*a* and 10*b* is connected by intermediate switching of a digital signal processor DSP to a data processing unit 11, wherein the data processing unit 11 processes the print data as an image of a print line 12. The data processing unit 11 is connected to a unit 13 for generating the print cycle.

The data processing unit 11 is formed of a microprocessor with program storage and data storage, interfaces for receiving data and a character generator and two direct memory access DMA channels with direct memory access. The two digital signal processors DSP1 and DSP2 receive a straight print column from the data processing unit 11. The digital signal processors DSP1 and DSP2 have to process the print data corresponding to the incorporation angle 4 of the nozzle heads 10*a* and 10*b* and deliver the print data dependent on the print cycle, which is generated by the unit 13 (print control unit), to the nozzle heads 10*a* and 10*b*. The digital signal processors DSP1 and DSP2 can be constructed as is taught for example in U.S. Pat. No. 5,563,955.

Figure 4:
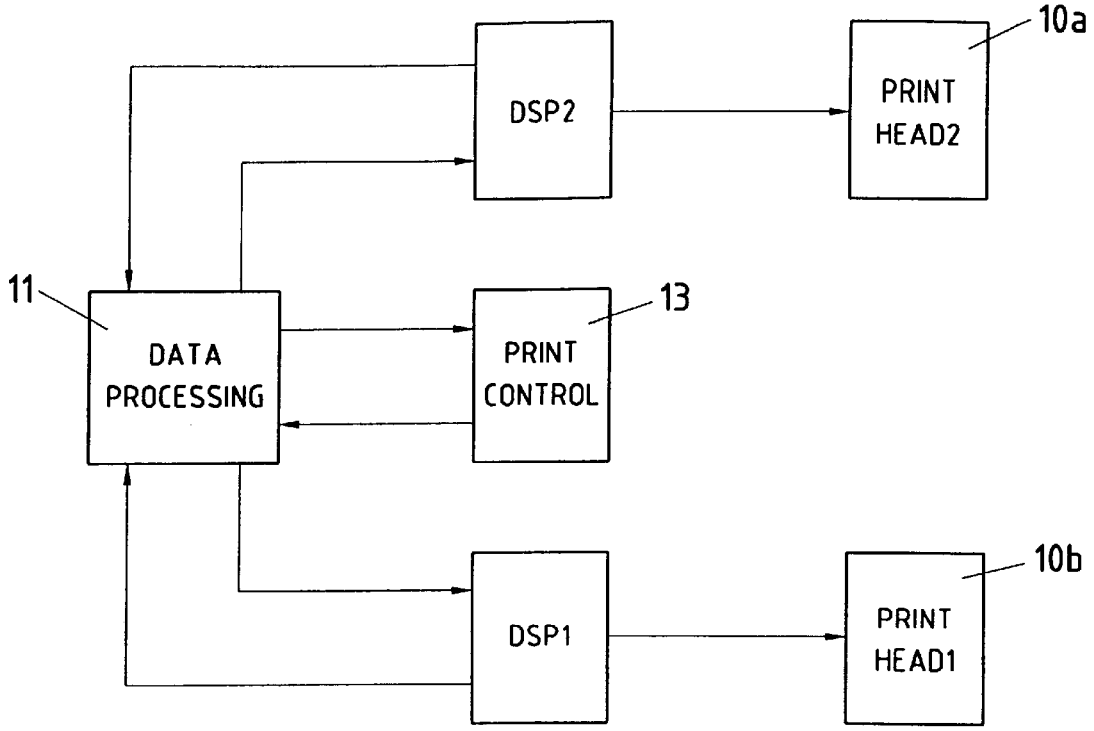
FIG. 4 shows a respective block circuit diagram employing a digital signal processor.

The device group illustrated in FIG. 4 serves further for the purpose to process the print data with the character generator or by receiving graphic print data from a host computer in a printer buffer such that an image corresponds to a print line. The device group is therefore independent of the incorporation angle 4 of the nozzle heads 10*a*, 10*b* and processes the data as if the nozzle heads 10*a*, 10*b* were disposed vertically. The direct memory access DMA channels of the data processing unit 11 serve for transferring the processed data to the digital signal processor DSP1 or, respectively, the digital signal processor DSP2. The momentarily active mode is communicated through four control lines to the digital signal processor DSP1 or, respectively, DSP2. In addition, information relating to print density and distance of the two nozzle heads 10*a*, 10*b* are transferred to the unit 13 for generating the print cycle.

Figure 5:
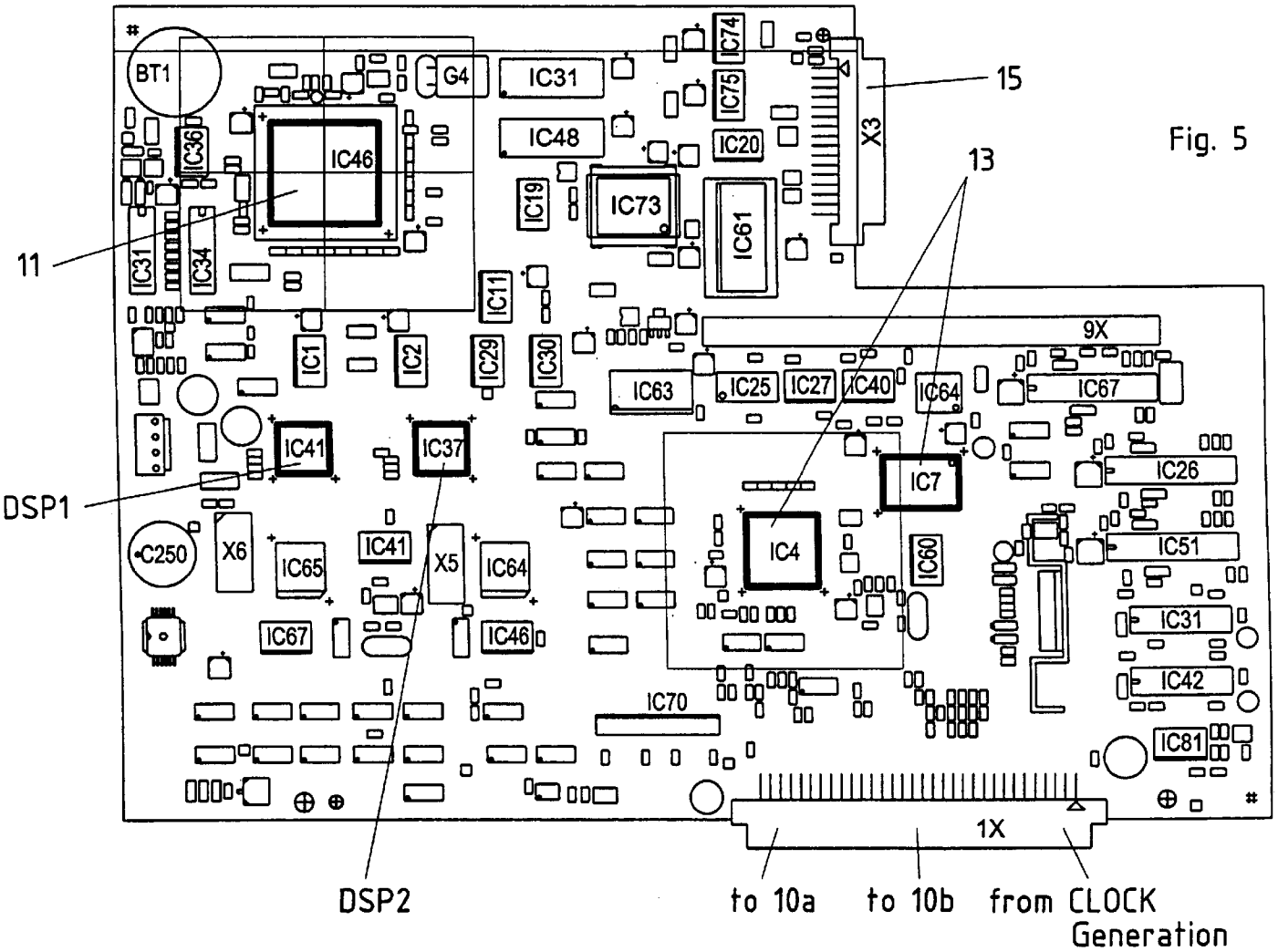
FIG. 5 is a top planar view onto a control circuit board of an ink jet printer, wherein the parts shown in FIG. 4 are illustrated in more detail.

FIG. 5 shows a control circuit board of an ink jet printer. The data processing unit 11 is connected to the first digital signal processor DSP1 and to the second digital signal processor DSP2. A unit 13 for generating the printing cycle is connected to the data processing unit 11. A plug strip 25 is furnished for interconnecting the first nozzle head 10*a* and for connecting the second nozzle head 10*b*. An interface 15 is furnished for connecting to a host such as a computer.

Figure 6:
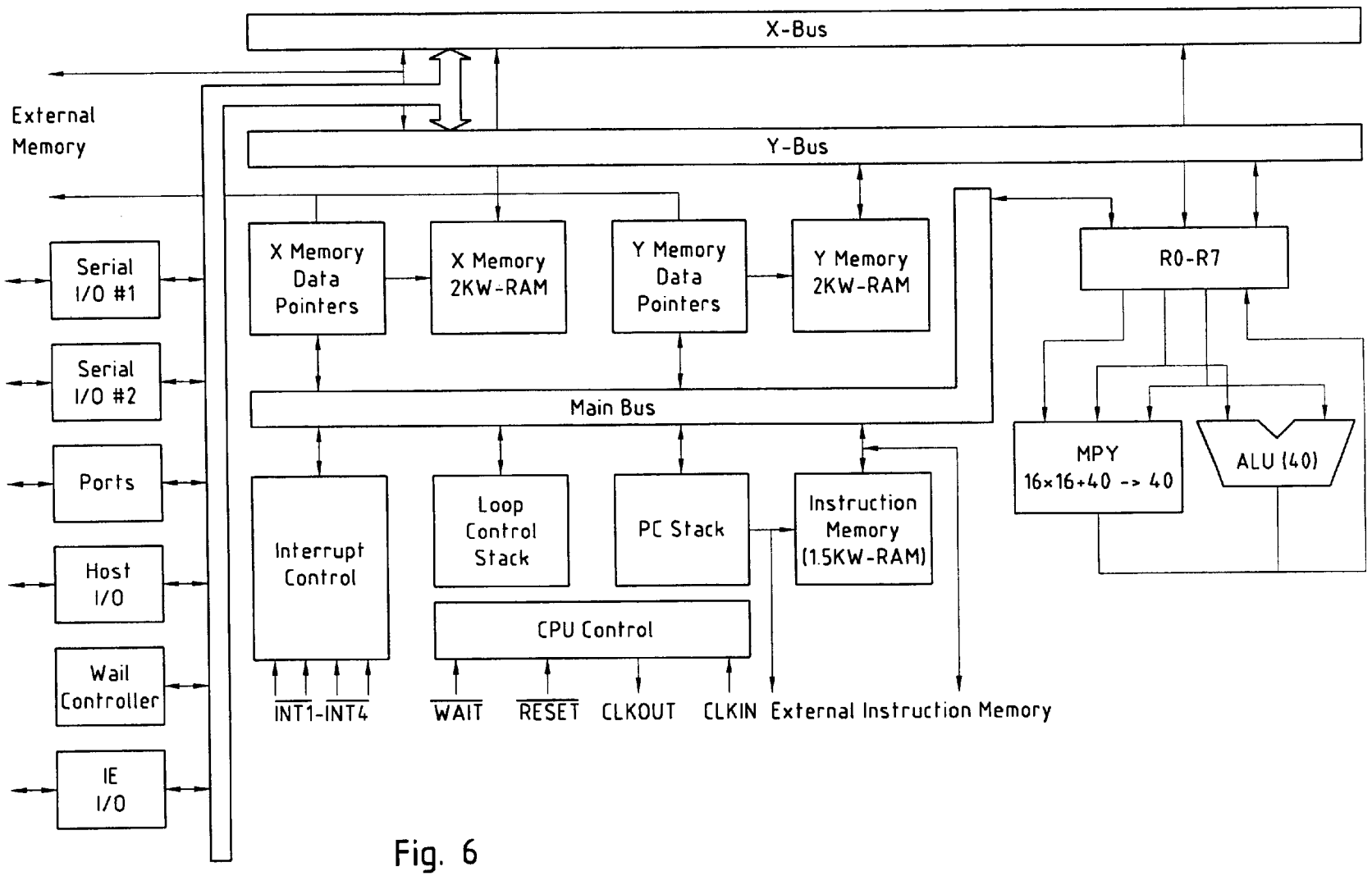
FIG. 6 is a view of a block circuit diagram illustrating the digital signal processors DSP1 and DSP2.

FIG. 6 is a view of a block circuit diagram illustrating the construction of the digital signal processors DSP1 and DSP2. The essential functional groups of the digital signal processors DSP1 and DSP2 are illustrated. The data flow between the individual functional groups is indicated by arrows for easy recognition.

The inclination angle depends on the number n of dots belonging to the repeat group. The inclination angle alpha of the row of nozzles can be calculated depending on the number n of dots belonging to the repeat group, a variable natural number x assuming values between 1 and n−1 defining essentially the delays associated with the various dots of the group, and preferably assuming values 1 and n−1, and a variable natural number "a" essentially defining the size of the slope and inclination of the nozzle column and preferably assuming small values such as 1, 2, 3. The inclination angle alpha can then be calculated by the following formula:

$$\text{tang(alpha)}=n/((a\cdot n)-x).$$

Figure 7:
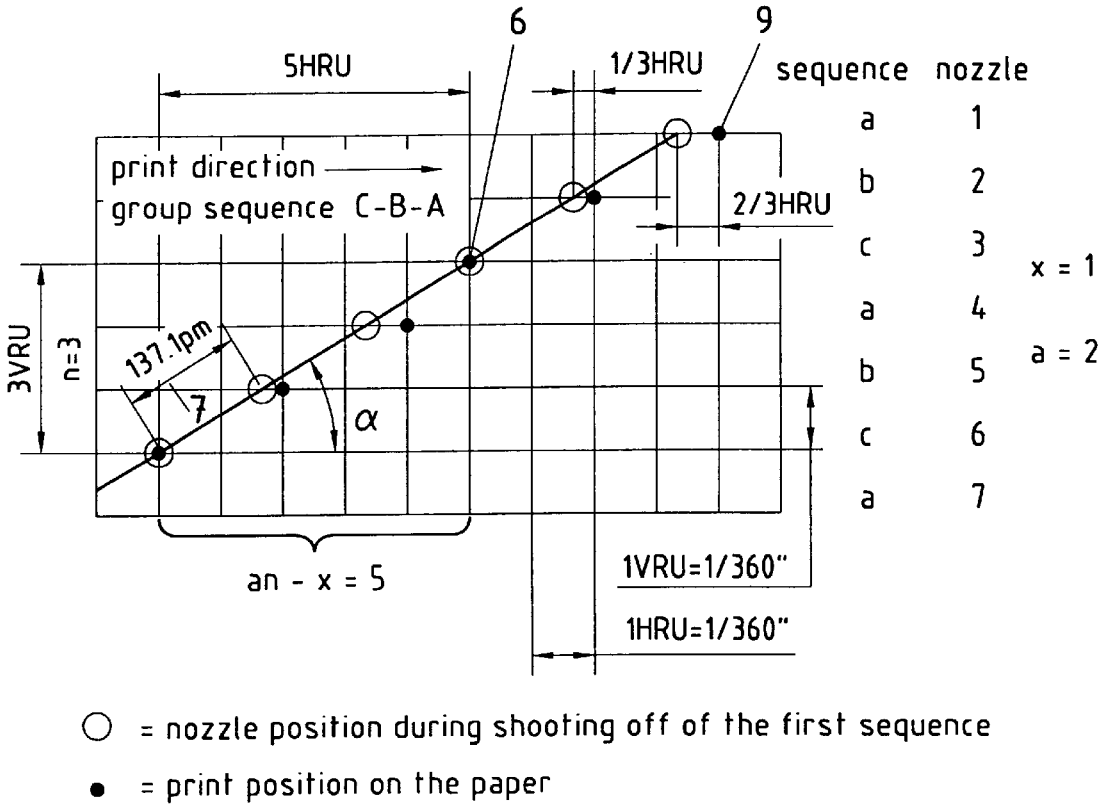
FIG. 7 shows a shooting sequence and its relationship to the formula defining possible inclination angles of the nozzle pattern.

The resulting delays are multiples of the ratio x/n times the time distance between two neighboring grid points or pixels in a line. An example for such a relation is shown in FIG. 7. The electronic circuit can be constructed such that the parameters n, x, a can be entered as desired and the apparatus adjusted depending on other parameters and requirements.

The course of functioning is presented as follows:

The print data, received from the interface out of the host computer, are processed to vertical print columns 14 in the data processing unit 11 with the character generator dependent on the set print density. The vertical processed print data are transferred by the data processing unit 11 with the direct memory access DMA channels to the digital signal processors DSP1 and DSP2. The transfer is performed column by column, wherein one print column comprises in each case 16 bytes for the digital signal processor DSP1 and DSP2. A print cycle, derived from a line ruler and generated in the unit 13 for the generation of the print cycle serves as a signal for the transfer. The line ruler can be recognized from FIGS. 1 and 3 and represents the intended network. As soon as the respective nozzle head 10*a* or 10*b* reaches the position, determined for the vertical print column 14, then a starting signal (DMA request) is released over the unit 13 for generating the print cycle and the first byte of the column is transferred to the digital signal processors DSP1 or, respectively, DSP2. After receiving the 16 bytes (=128 nozzles), a complete straight print column 14 has been received by the respective digital signal processor. This straight, vertical print column 14 has to be positioned inclined relative to the physical incorporation angle 4 of the nozzle head 10*a* or, respectively, 10*b*, and stored by the digital signal processor DSP1 or, respectively, DSP2. The internal random access memory RAM of the digital signal processors DSP1 or, respectively, DSP2 can be employed for the storage. The size of the random access memory RAM required for this purpose depends on the incorporation angle 4 of the nozzle head 10*a* or, respectively, 10*b* as well as the number of the nozzles 3. The random access memory RAM is constructed as an annular buffer and has to be able to store at least one inclined positioned print column. Upon receipt of a straight, vertical print column 14, the digital signal processor DSP1 or, respectively, DSP2 sends simultaneously already an inclined positioned column to the nozzle head 10*a* or, respectively, 10*b* through a serial interface. The described process starts anew with the next print cycle.

The described functional process can be applied in principle also to one or several nozzle heads 10*a*, 10*b* with different incorporation angles.

A nonlinear time delay relative to the nozzle position can also be applied for shooting off individual nozzles, wherein the nonlinearity in time amounts to at least 5 percent of a hypothetical straight line time delay value, and wherein an incorporation position of 360 dpi is furnished.

It will be understood that each of the elements described above, or two or more together, may also find a useful application in other methods and types of circuits for controlling nozzle heads differing from the types described above.

While the invention has been illustrated and described as embodied in the context of a method and circuit for controlling nozzle heads in inkjet printers, in particular nozzle heads of piezoelectric construction, it is not intended to be limited to the details shown, since the various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A circuit for controlling nozzle heads in inkjet printers comprising:

a first plurality of nozzles disposed in a row forming an angle relative to a horizontal and to a line direction, respectively, wherein the nozzles of the first plurality of nozzles exhibit a defined distance from each other, and wherein the nozzles of the first plurality of nozzles are to be shot off without a time delay;

a second plurality of nozzles disposed in a row forming an angle relative to a horizontal and to a line direction, respectively, and electronically distinguished from the first plurality of nozzles, wherein the nozzles of the second plurality of nozzles exhibit a defined distance from each other, and wherein the nozzles of the second group of nozzles are disposed interleaved relative to the first plurality of nozzles, and wherein the nozzles of the second plurality of nozzles are to be shot off with a time delay of a fraction of a pixel distance;

a third plurality of nozzles disposed in a row forming an angle relative to a horizontal and to a line direction, respectively, and electronically distinguished from the first plurality of nozzles and from the second plurality of nozzles, wherein the nozzles of the third plurality of nozzles exhibit a defined distance from each other, and wherein the nozzles of the third group of nozzles are disposed interleaved relative to the first plurality of nozzles and relative to the second plurality of nozzles, and wherein the nozzles of the third plurality of nozzles are to be shot off with a time delay of a multiple of said fraction of the pixel distance;

a digital signal processor connected to the first plurality of nozzles, to the second plurality of nozzles and to the third plurality of nozzles for controlling the first plurality of nozzles, the second plurality of nozzles, and the third plurality of nozzles;

a data processing unit connected to the digital signal processor for switching the digital signal processor;

a unit for generating a print cycle connected to the data processing unit for delivering print data to the data processing unit, wherein the data processing unit processes print data as an image of a print line.

2. The circuit according to claim 1, wherein nozzle heads of the first plurality of nozzles, of the second plurality of nozzles, and of the third plurality of nozzles are of piezo construction, wherein the nozzles of the first plurality of nozzles, of the second plurality of nozzles, and of the third plurality of nozzles are physically closely spaced, wherein the first plurality of nozzles, the second plurality of nozzles, and the third plurality of nozzles are disposed on the nozzle heads with each having 128 nozzles and furnishing a point grid of 360 dpi.

3. The circuit according to claim 1, wherein the data processing unit includes:

a microprocessor;

a program storage connected to the microprocessor;

a data storage connected to the microprocessor;

interfaces connected to the microprocessor for receiving data;

a character generator connected to the microprocessor;

a memory connected to the microprocessor; and two direct memory access DMA channels connected to the memory and furnished with a direct memory access.

4. The circuit according to claim 1, wherein the nozzles of the second plurality of nozzles are shot off with a time delay corresponding to ⅓ of the distance between two pixels, and wherein the nozzles of the third plurality of nozzles are shot off with a time delay corresponding to ⅔ of the distance between two pixels.

5. The circuit according to claim 1, wherein the digital signal processor is constructed to allow firing successively different sequences of the first plurality of nozzles, of the second plurality of nozzles, and of the third plurality of nozzles.

6. The circuit according to claim 1, wherein the pixels are time delayable relative to an inclination position of the nozzle row for printing a vertical line.

7. The circuit according to claim 1, wherein a nonlinear time delay relative to a nozzle position is to be applied for shooting off individual nozzles in an incorporation position of 360 dpi.

8. The circuit according to claim 1, wherein a tangent of the angle (alpha) relative to the horizontal and to the line direction, respectively, is defined by the following formula:

$$\text{tang(alpha)}=n/((a\cdot n)-x),$$

wherein n is equal to a natural number at least 1, x is equal to a natural number between 1 and n−1, a is equal to a second natural number.

9. The circuit according to claim 8, wherein the tangent of the angle (alpha) is defined by parameters as follows:

n is less than 10, x is equal to 1 or n−1, a is not larger than n.

10. The circuit according to claim 8, wherein the tangent of the angle (alpha) is defined by parameters as follows:

n is equal to 3, x is equal to 1, a is equal to 2.

11. The circuit according to claim 1, wherein the digital signal processor is a digital signal microprocessor.

12. The circuit according to claim 1, wherein the digital signal processor is a general purpose microprocessor working faster than a common digital signal microprocessor.

13. A circuit for controlling nozzle heads in inkjet printers comprising:

nozzle heads of piezo construction, with physically closely spaced nozzles having a distance from nozzle center to nozzle center of from about 0.08 to 0.15 millimeters, wherein the nozzles are disposed in a row forming an angle relative to a horizontal or, respectively, to a line direction, respectively, wherein an inclined nozzle row is electronically subdivided into groups (A, B, C), wherein furthermore in each case the nozzles belonging to a group (A or B or C) jump over the nozzles of a other group (A or B or C), such that the nozzles exhibit a physical distance within an electronically controllable group (A, B, C), and wherein in addition the nozzles of the first group (A) can be shot off without a time delay, the nozzles of the second group (B) can be shot off with a time delay by a fraction of a pixel, and the nozzles of the third group (C) can be shot off with a time delay by a multiple of this fraction of a pixel, a data processing unit (11) connected to the nozzles disposed in the row (1) and having an intermediate positioning and switching of a digital signal processor (DSP) for a control of the nozzle heads (10*a*, 10*b*), wherein the data processing unit (11) processes print data as an image of a print line (12), and a unit (13) for generating a print cycle connected to the data processing unit (11).

14. The circuit according to claim 13, wherein the data processing unit (11) is formed by a microprocessor with a program storage and a data storage, interfaces for receiving data, a character generator, and two direct memory access DMA channels with a direct memory access.

15. The circuit according to claim 13, wherein the nozzles of the second group are shot off with a time delay corresponding to ⅓ of a distance between two pixels, and wherein the nozzles of the third group are shot off with a time delay corresponding to ⅔ of a distance between two pixels.

16. The circuit according to claim 13, wherein different sequences (x, y, z) of the groups (A-B-C or C-B-A) can be released successively.

17. The circuit according to claim 13, wherein the nozzles are time delayable relative to an inclination position of the nozzle row for printing a vertical line.

18. The circuit according to claim 13, wherein a nonlinear time delay is to be applied for shooting off individual nozzles in an incorporation position of 360 dpi.

19. A circuit for controlling nozzle heads (10*a*, 10*b*) movable in a line direction (5) relative to a recording material in inkjet printers comprising:

nozzle heads (10*a*, 10*b*) of piezo construction, nozzles (3) supporting the nozzle heads (10*a*, 10*b*) and disposed physically closely spaced, wherein the nozzles (3) form nozzle rows (1) running at an angle (4) relative to the line direction (5), wherein the nozzles (3) of one nozzle row (1) are connected to a data processing unit (11) and are electronically subdivided into groups (A, B, C), wherein in each case the nozzles (3) belonging to a group (A, B, C) jump over the nozzles (3) of another group (A, B, C), such that the nozzles (3) exhibit a physical distance within a group (A, B, C), and wherein the nozzles (3) of a first group (A) can be shot off without a time delay, the nozzles (3) of a second group (B) can be shot off with a time delay by a fraction of a pixel distance relative to the nozzles (3) of the first group (A), and the nozzles (3) of a third group (C) can be shot off with a time delay by a multiple of this fraction of the pixel distance relative to the nozzles (3) of the first group (A), a data processing unit (11) connected to the nozzle rows (1) and having an intermediate positioning and switching of a digital signal processor (DSP) for a control of the nozzle heads (10*a*, 10*b*) with a large number of nozzles and a fixed mounting position, wherein the data processing unit (11) processes print data as an image of a print line (12), and wherein the data processing unit (11) is connected to a unit (13) for generating a print cycle.

20. A method for controlling nozzle heads in inkjet printers comprising the steps of:

disposing nozzles at a defined distance from each other in a row;

disposing the row at an angle relative to a horizontal or, respectively, to a line direction;

subdividing the nozzles disposed in the row into a first plurality of nozzles, a second plurality of nozzles, and a third plurality of nozzles such that the nozzles of the third group of nozzles are disposed interleaved relative to the first plurality of nozzles and relative to the second plurality of nozzles;

connecting a digital signal processor to the first plurality of nozzles, to the second plurality of nozzles, and to the third plurality of nozzles for controlling the first plurality of nozzles, the second plurality of nozzles, and the third plurality of nozzles;

connecting a data processing unit to the digital signal processor for switching the digital signal processor;

connecting a unit for generating a print cycle to the data processing unit for delivering print data to the data processing unit, wherein the data processing unit processes the print data as an image of a print line;

electronically distinguishing the first plurality of nozzles, the second plurality of nozzles, and the third plurality of nozzles;

shooting off the nozzles of the second plurality of nozzles with a time delay of a fraction of a pixel distance; shooting off the nozzles of the third plurality of nozzles with a time delay of a multiple of said fraction of the pixel distance.

21. The method according to claim 20, wherein the second plurality of nozzles to be shot off with a time delay are shot-off with a time delay corresponding to ⅓ of the distance between two pixels, and wherein the third plurality nozzles to be shot off with a time delay are shot-off with a time delay corresponding to ⅔ of the distance between two pixels.

22. The method according to claim 20, wherein the angle (alpha) is defined by the following formula:

$$\text{tang(alpha)}=n/((a\cdot n)-x),$$

wherein n is equal to a natural number at least 1, x is equal to a natural number between 1 and n−1, a is equal to a second natural number.

23. A method for controlling nozzle heads in inkjet printers comprising the steps:

disposing nozzle heads of piezo construction, with physically closely spaced nozzles, wherein the nozzles are disposed in an inclined nozzle row, electronically subdividing the inclined nozzle row into groups (A, B, C ), wherein nozzles belonging to one group (A or B or C) jump in each case over the nozzles of another group (A or B or C), such that the nozzles exhibit a physical distance within an electronically controllable group (A, B, C), shooting off the nozzles of a first group (A) without a time delay, shooting off the nozzles of a second group (B) with a time delay corresponding to a fraction of a distance between two pixels, shooting off the nozzles of a third group (C) with a time delay corresponding to a multiple of this fraction of the distance between two pixels;

disposing grid points time-delayed relative to an inclination position of the nozzle head or, respectively, of the nozzle row for printing a vertical line; and applying a nonlinear delay for shooting of individual nozzles with an incorporation position of 360 dpi.

24. The method according to claim 23, wherein the nozzles to be shot off with a time delay are shot-off with a time delay corresponding to ⅓ of the distance between two pixels, and wherein additional nozzles to be shot off with a time delay are shot-off with a time delay corresponding to ⅔ of the distance between two pixels; and wherein different sequences of the groups (A-B-C or C-B-A) are released successively.

25. The circuit according to claim 2, wherein the data processing unit includes:

a microprocessor;

a program storage connected to the microprocessor;

a data storage connected to the microprocessor;

interfaces connected to the microprocessor for receiving data;

a character generator connected to the microprocessor;

a memory connected to the microprocessor; and two direct memory access DMA channels connected to the memory and furnished with a direct memory access.

* * * * *